US012782059B2

(12) United States Patent
Papoulis et al.

(10) Patent No.: US 12,782,059 B2
(45) Date of Patent: Nov. 3, 2026

(54) COMBINATION HEAT EXCHANGER

(71) Applicant: Hanon Systems, Daejeon (KR)

(72) Inventors: Evangelos Papoulis, Novi, MI (US); Chao Zhang, Novi, MI (US); Nicos Agathocleous, Novi, MI (US); William Abate, Novi, MI (US); Kenneth Belford, Novi, MI (US); Robert Sorensen, Novi, MI (US)

(73) Assignee: HANON SYSTEMS, Daejeon (KR)

( * ) Notice: Subject to any disclaimer, the term of this patent is extended or adjusted under 35 U.S.C. 154(b) by 24 days.

(21) Appl. No.: 18/620,162

(22) Filed: Mar. 28, 2024

(65) Prior Publication Data

US 2024/0426557 A1 Dec. 26, 2024

Related U.S. Application Data

(60) Provisional application No. 63/509,762, filed on Jun. 22, 2023.

(51) Int. Cl.
*F28D 9/00* (2006.01)

(52) U.S. Cl.
CPC ..... *F28D 9/005* (2013.01); *F28D 9/0093* (2013.01)

(58) Field of Classification Search
CPC ..... F28D 9/005; F28D 9/0093
See application file for complete search history.

(56) References Cited

U.S. PATENT DOCUMENTS

| | | | | |
|---|---|---|---|---|
| 5,462,113 | A * | 10/1995 | Wand | F28D 9/0093 165/140 |
| 2003/0201094 | A1* | 10/2003 | Evans | F28D 9/005 165/167 |
| 2008/0196871 | A1* | 8/2008 | Lavanchy | F28D 9/0093 165/143 |
| 2017/0030254 | A1* | 2/2017 | Tokozakura | F01P 11/08 |
| 2017/0030255 | A1* | 2/2017 | Tokozakura | F01P 11/08 |
| 2022/0236017 | A1* | 7/2022 | Benouali | H01M 10/625 |
| 2023/0003458 | A1* | 1/2023 | Azzouz | F28D 9/005 |
| 2024/0295365 | A1* | 9/2024 | Tissot | F28D 9/0093 |

FOREIGN PATENT DOCUMENTS

| | | | |
|---|---|---|---|
| CN | 1151207 | A | 6/1997 |
| CN | 106403669 | B | 12/2018 |
| CN | 215864803 | U * | 2/2022 |
| CN | 114981606 | A | 8/2022 |

(Continued)

OTHER PUBLICATIONS

Translation of CN215864803U named Translation-CN215864803U (Year: 2022).*

(Continued)

*Primary Examiner* — Paul Alvare
(74) *Attorney, Agent, or Firm* — Shumaker, Loop & Kendrick, LLP; James D. Miller

(57) ABSTRACT

A heat exchanger comprising a plurality of first plates and a plurality of second plates disposed between two end plates. The first plates and the second plates are alternatingly arranged in a stacked relationship. When in the stacked relationship, the first and second plates form at least a first flow path for a first fluid/medium, a second flow path for a second fluid/medium, and a third flow path for a third fluid/medium.

17 Claims, 14 Drawing Sheets

(56) References Cited

FOREIGN PATENT DOCUMENTS

| | | | | | |
|---|---|---|---|---|---|
| JP | 2016090217 | A * | 5/2016 | ..... | F28F 3/027 |
| KR | 1020200080795 | A | 7/2020 | | |
| WO | WO-2014095573 | A1 * | 6/2014 | ..... | F25B 39/04 |

OTHER PUBLICATIONS

Translation of JP2016090217A named Translation-JP2016090217A (Year: 2016).*
Translation of WO2014095573A1 named Translation-WO2014095573A1 (Year: 2014).*

* cited by examiner

COMBINATION HEAT EXCHANGER

CROSS-REFERENCE TO RELATED APPLICATION

This application claims the benefit of U.S. Provisional Patent Application Ser. No. 63/509,762, filed Jun. 22, 2023, the entirety of which is herein incorporated by reference.

FIELD

The disclosure relates to a heat exchanger, and more particularly to a combination heat exchanger.

BACKGROUND

Conventional air-conditioning and thermal management systems include a heat exchanger, for example, a plate heat exchanger. Plate type heat exchangers consist of stacked plates in which a refrigerant and/or a coolant flows through intermediate spaces between adjacent plates, wherein the refrigerant flows from a first side of the plate heat exchanger to the opposite second side of the plate heat exchanger, while the coolant flows parallel to the refrigerant or in the opposite direction from the same end but opposite side or the opposite end to the first end of the plate heat exchanger. The length of the flow channels in the plate heat exchanger corresponds here essentially to the length of the plate heat exchanger from the first end to the second end. The outer dimensions of the plate heat exchanger and the position of the connections of the plate heat exchanger are therefore defining the length of the flow channels in the plate heat exchanger.

Typically, the air-conditioning and thermal management systems further include a compressor, a water-cooled condenser, chillers, integrated heat exchanger, and an economizer. The pressure drop resulting from the separate components, particularly on a refrigerant side, limits the operating range of the compressor and affects the efficiency of the system.

It is desirable to develop a compact and versatile combination heat exchanger having unique and efficient flow circuitry.

SUMMARY

In concordance and agreement with the presently described subject matter, an integrated-plated combination heat exchanger with a compact and versatile design as well as unique and efficient flow circuitry for use in a vehicle, in particular an electric vehicle, has surprisingly been discovered.

An object of the disclosure is to provide a first fluid/medium to transfer thermal energy to a plurality of working fluid/mediums. A common circuit is shared amongst multiple independent heat exchangers. Preferably, the common circuit exchanges thermal energy with independent circuits to perform the functions of at least one of a water-cooled condenser, a chiller, an economizer, and a plate-integrated heat exchanger.

Another object of the disclosure is to provide a plurality of fluid/mediums to transfer thermal energy to a plurality of working fluid/mediums. Two circuits are divided amongst multiple independent heat exchangers. Preferably, the circuits exchange thermal energy with the independent circuits to perform the functions of at least one of a water-cooled condenser, a chiller, an economizer, and a plate-integrated heat exchanger.

A construction of a combination heat exchanger may be of a nested stack plate with ports positioned at various locations in the plates. The location of the ports may be adjusted to control a performance of each function of the combination heat exchanger. The combination heat exchanger of the disclosure may further include one or more transfer devices (e.g., fins) to enhance a transfer of thermal energy.

In one embodiment, a heat exchanger comprises: a plurality of first plates; and a plurality of second plates alternatingly arranged with the first plates to form at least three flow paths for at least three fluids/mediums, wherein each of the fluids/mediums is in thermal energy exchange relationship with at least another one of the fluids/mediums.

In another embodiment, a heat exchanger, comprises: a plurality of first plates; and a plurality of second plates alternatingly arranged with the first plates to form a first flow path for a first fluid/medium, a second flow path for a second fluid/medium, and a third flow path for a third fluid/medium, wherein the first fluid/medium is in thermal energy exchange relationship with the second fluid/medium and the third fluid/medium.

In yet another embodiment, a heat exchanger, comprises: a plurality of first plates; and a plurality of second plates alternatingly arranged with the first plates to form a first flow path for a first fluid/medium, a second flow path for a second fluid/medium, a third flow path for a third fluid/medium, and a fourth flow path for a fourth fluid/medium, wherein the first fluid/medium is in thermal energy exchange relationship with the second fluid/medium and the third fluid/medium is in thermal energy exchange relationship with the fourth fluid/medium.

As aspects of some embodiments, at least one of the first and second plates includes at least one divider to define a first portion of the heat exchanger and a second portion of the heat exchanger.

As aspects of some embodiments, the second flow path is located entirely in the first portion of the heat exchanger and the third flow path is located entirely in the second portion of the heat exchanger.

As aspects of some embodiments, at least one of the first flow path and the second flow path is located entirely in the first portion of the heat exchanger.

As aspects of some embodiments, at least one of the third flow path and the fourth flow path is located entirely in the second portion of the heat exchanger.

As aspects of some embodiments, at least one of the first and second plates includes at least three inflow openings and at least three outflow openings.

As aspects of some embodiments, at least one of the first and second plates includes at least one shaped section surrounding at least one inflow opening.

As aspects of some embodiments, at least one of the first and second plates includes at least one shaped section surrounding at least one outflow opening.

As aspects of some embodiments, the heat exchanger further comprises at least one end plate disposed adjacent at least one of the first and second plates.

As aspects of some embodiments, the at least one end plate includes at least three inlet ports.

As aspects of some embodiments, the at least one end plate includes at least three outlet ports.

Further areas of applicability will become apparent from the description provided herein. The description and specific examples in this summary are intended for purposes of illustration only and are not intended to limit the scope of the present disclosure.

BRIEF DESCRIPTION

The drawings described herein are for illustrative purposes only of selected embodiments and not all possible implementations, and are not intended to limit the scope of the present disclosure.

DETAILED DESCRIPTION

Figure 1:
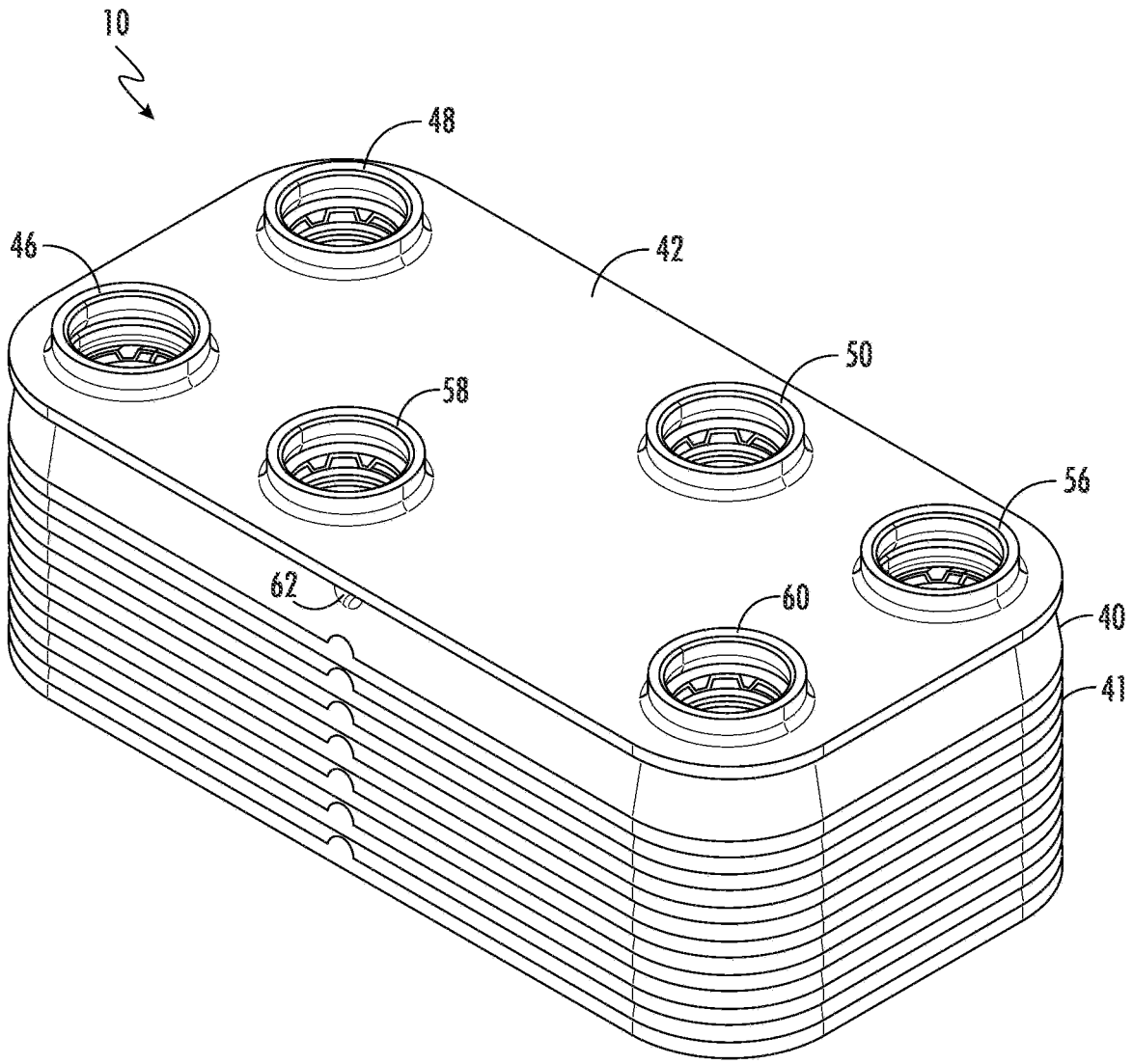
FIG. 1 shows a perspective view of a combination heat exchanger in accordance with an embodiment of the presently described subject matter, wherein the combination heat exchanger includes a plurality of plates and one or more transfer devices in a stacked relationship.

The following description of technology is merely exemplary in nature of the subject matter, manufacture and use of one or more present disclosures, and is not intended to limit the scope, application, or uses of any specific present disclosure claimed in this application or in such other applications as may be filed claiming priority to this application, or patents issuing therefrom. Regarding methods disclosed, the order of the steps presented is exemplary in nature, and thus, the order of the steps may be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. The device may be otherwise oriented (rotated 90 degrees or at other orientations) and the spatially relative descriptors used herein interpreted accordingly.

A conditioning system (not depicted) may comprise one or more of various embodiments of combination heat exchangers 10, 100, as shown in FIGS. 1-14B, and described in detail hereinafter. The combination heat exchangers 10, 100 are depicted as plate heat exchangers, however, it is understood that each of the combination heat exchangers 10, 100 may be other various types of heat exchangers if desired. The combination heat exchanger 10 may be in communication (e.g., fluid communication) with a first circuit 12 for a first fluid/medium (e.g., a refrigerant, coolant, etc.), a second circuit 14 for a second fluid/medium (e.g. a refrigerant, a coolant, etc.), and a third circuit 16 for a third fluid/medium (e.g. a refrigerant, a coolant, etc.). The combination heat exchanger 100 may be in communication (e.g., fluid communication) with a first circuit 112 for a first fluid/medium (e.g., a refrigerant, coolant, etc.), a second circuit 114 for a second fluid/medium (e.g. a refrigerant, a coolant, etc.), a third circuit 116 for a third fluid/medium (e.g. a refrigerant, a coolant, etc.), and a fourth circuit 118 for a fourth fluid/medium (e.g., a refrigerant, a coolant, etc.). It should be appreciated that each of the fluid/mediums may have any desired pressure. For example, the first fluid/medium may be a high-pressure fluid/medium, the second fluid/medium may be a low-pressure fluid/medium, the third fluid/medium may be a medium-pressure fluid/medium, and the fourth fluid/medium may also be a low-pressure fluid/medium.

The conditioning system may comprise more or less components and devices as necessary for operation. For example, the conditioning system may further include a compressor, an evaporator, and an expansion valve.

The conditioning system may be employed in a vehicle. The vehicle may be, for example, a vehicle having an electric motor, in particular a hybrid vehicle or a pure electric vehicle, with a battery which is to be cooled by the conditioning system. It is understood, however, that the conditioning system may be used in various applications including, but not limited to, commercial, industrial, automotive, and residential applications.

The combination heat exchanger 10 being integrated into the first circuit 12, the second circuit 14, and the third circuit 16 permits the first fluid/medium to transfer thermal energy between the second fluid/medium and the third fluid/medium. In some embodiments, the combination heat exchanger 10 may function as a condenser, an economizer, and an integrated heat exchanger in at least one of the first and second circuits 12, 14 of the conditioning system. In preferred embodiments, the combination heat exchanger 10 permits the first fluid/medium (e.g., the refrigerant) to be cooled by the second fluid/medium (e.g., the refrigerant) and the third fluid/medium (e.g., the coolant).

A plurality of first plates 40 (i.e., A-plates) and a plurality of second plates 41 (i.e., B-plates) alternatingly arranged one on top of each other in a stacked relationship forming at least one A-B plate assembly 39 between opposing end plates 42, 44. It is understood that one or more of the end plates 42, 44 may be part of a housing of the combination heat exchanger 10 if desired. In a particular embodiment, the combination heat exchanger 10 includes seven (7) of the first plates 40 and seven (7) of the second plates 41 in stacked relationship between the end plates 42, 44. It is understood, however, that the combination heat exchanger 10 may include any number of the plates 40, 41 as desired.

Inlet ports 46, 48, 50 and corresponding outlet ports 56, 58, 60 for each of the first, second, and third circuits 12, 14, 16, respectively, are formed in one of the end plates 42, 44. In some embodiments, the inlet ports 46, 48, 50 and the outlet ports 56, 58, 60 are integrally formed with the one of the end plates 42, 44, yet in other embodiments they are formed as separate and distinct components that are coupled to the one of the end plates 42, 44.

FIGS. 1-7B show the first plates 40 and the second plate 41 of the combination heat exchanger 10 in accordance with an embodiment of the present disclosure. Each of the first and second plates 40, 41 and/or each of the end plates 42, 44 may be substantially elongate and rectangular. In some embodiments, each of the first and second plates 40, 41 may have a thickness of about 0.48 mm and each of the end plates 42, 44 may have a thickness of about 2.0 mm. However, it is understood that the first and second plates 40, 41 and the end plates 42, 44 may have various shapes, sizes, and configurations as desired.

Figure 4:
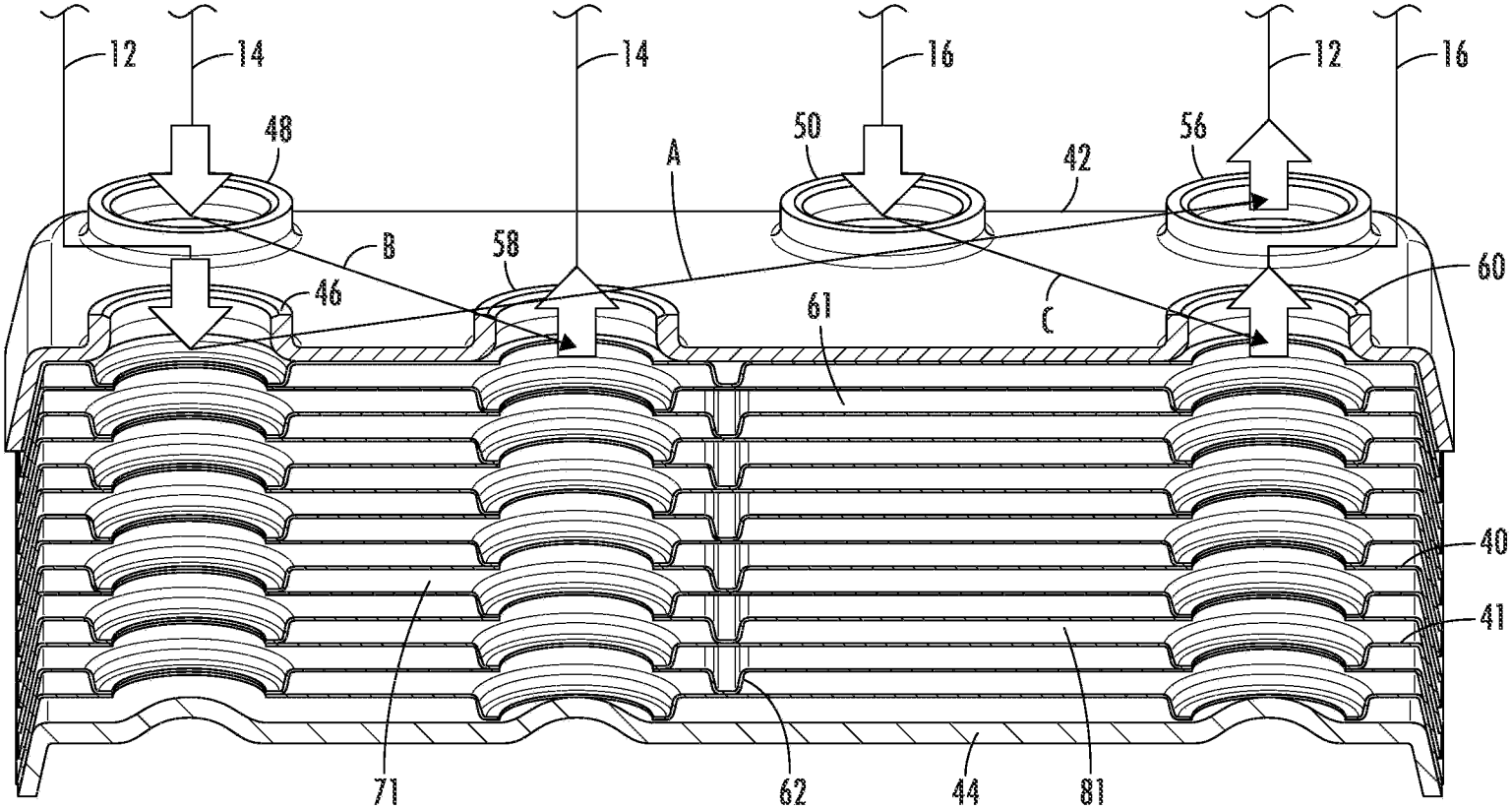
FIG. 4 shows a cross-sectional view of the combination heat exchanger of FIG. 1 depicting a flow circuitry thereof, wherein a first fluid/medium exchanges thermal energy with a second fluid/medium and a third fluid/medium.
Figure 5:
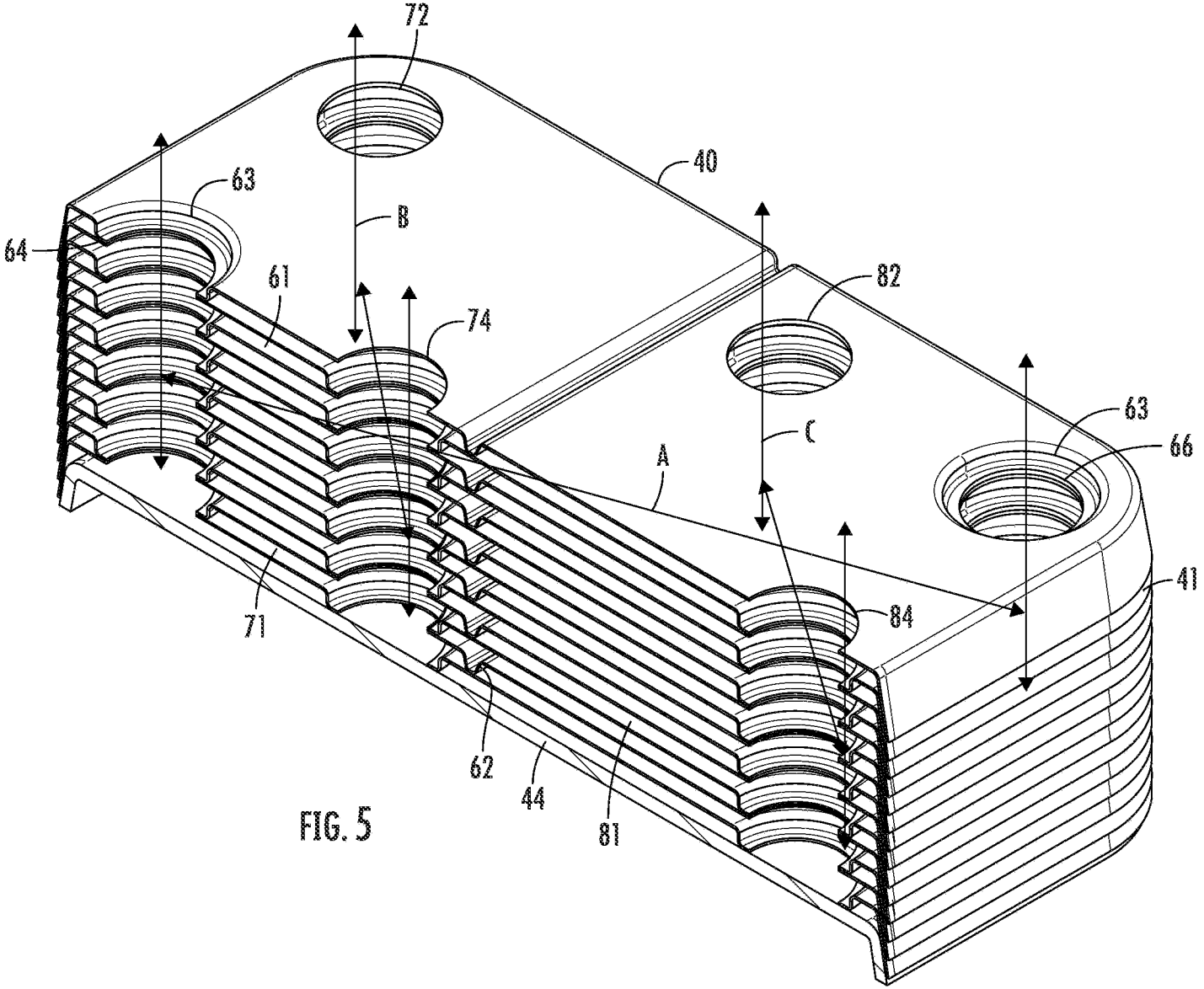
FIG. 5 shows a perspective sectional view of the combination heat exchanger of FIG. 1 depicting the flow circuitry thereof and an end plate removed, wherein the first fluid/medium exchanges thermal energy with the second fluid/medium and the third fluid/medium.
Figure 6:
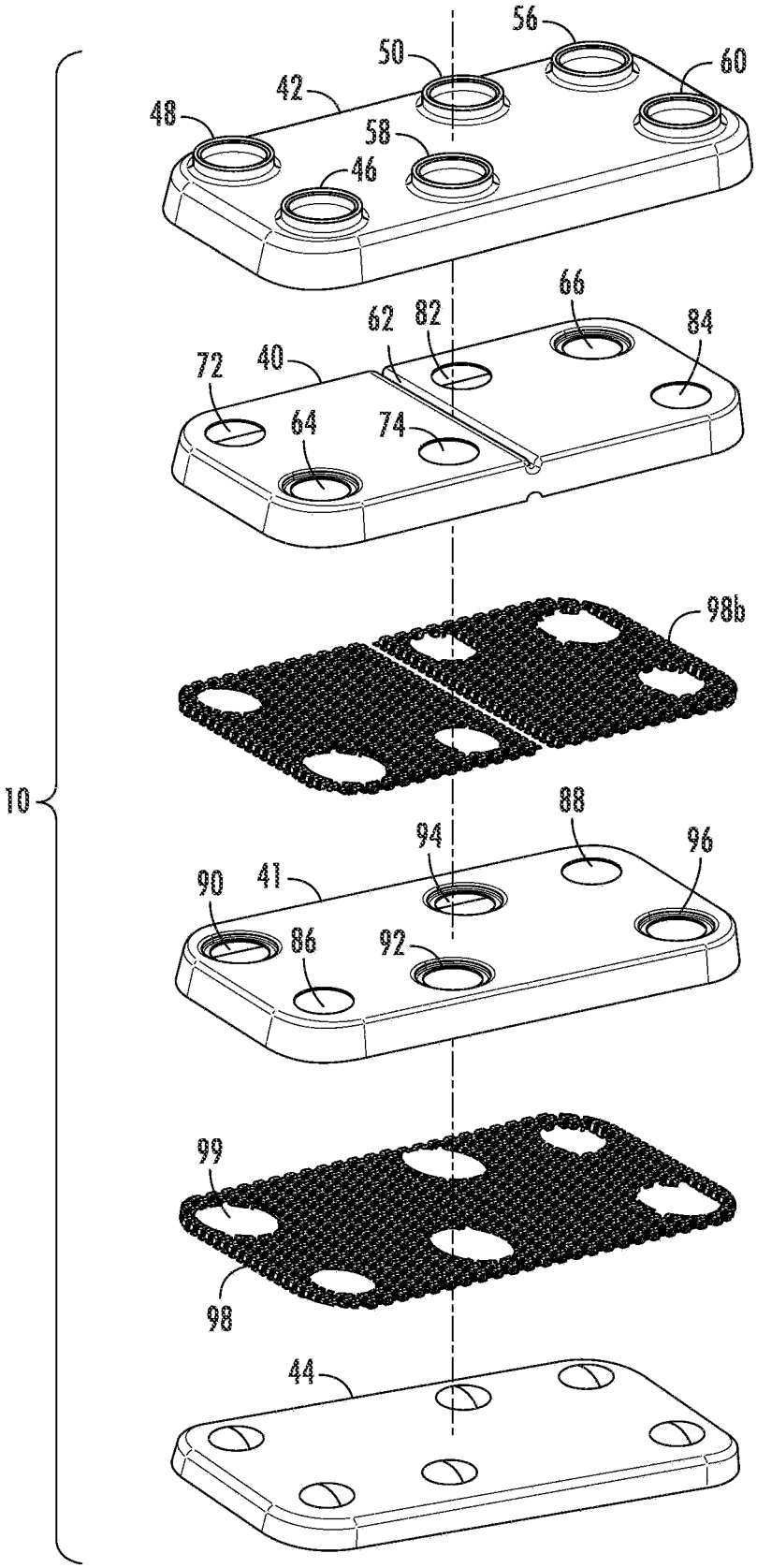
FIG. 6 shows an exploded view of the combination heat exchanger of FIG. 1.
Figure 7B:
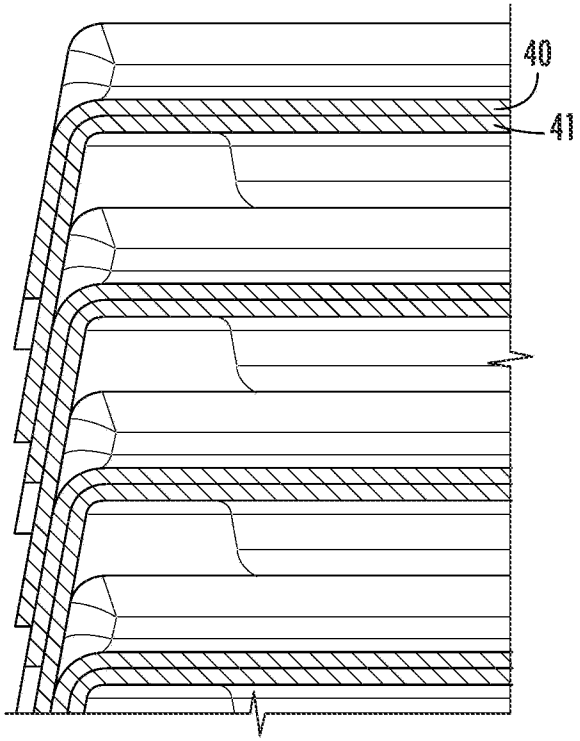
FIG. 7B shows a fragmentary cross-sectional view of an end portion of the combination heat exchanger of FIG. 1.
Figure 7A:
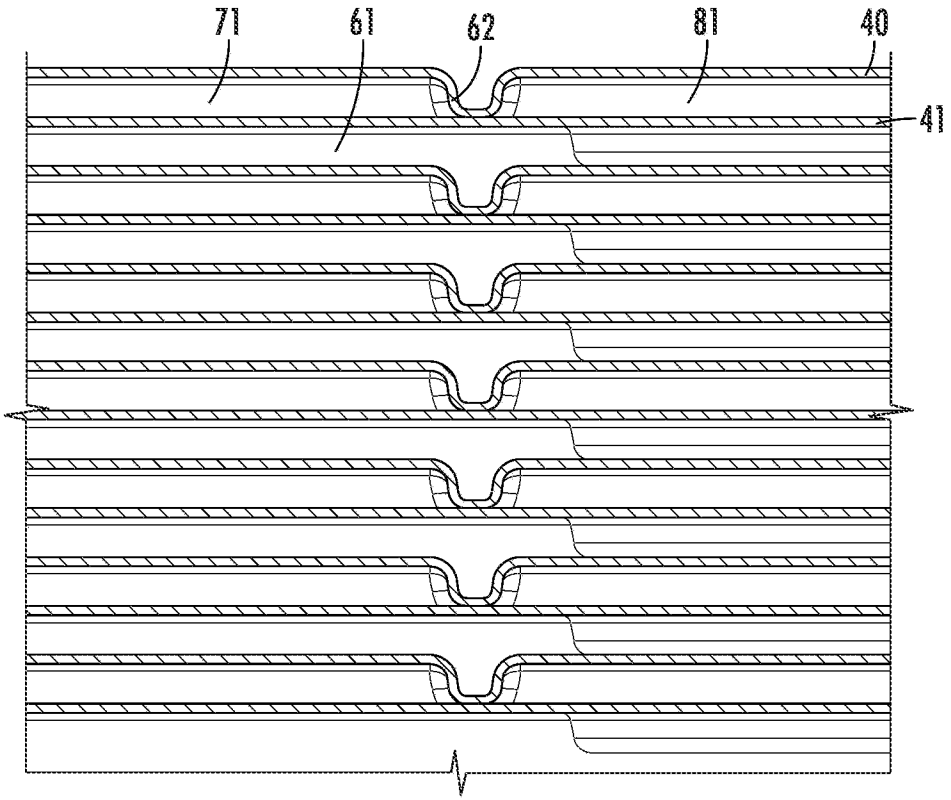
FIG. 7A shows a fragmentary cross-sectional view of an intermediate portion of the combination heat exchanger of FIG. 1.
Figure 8:
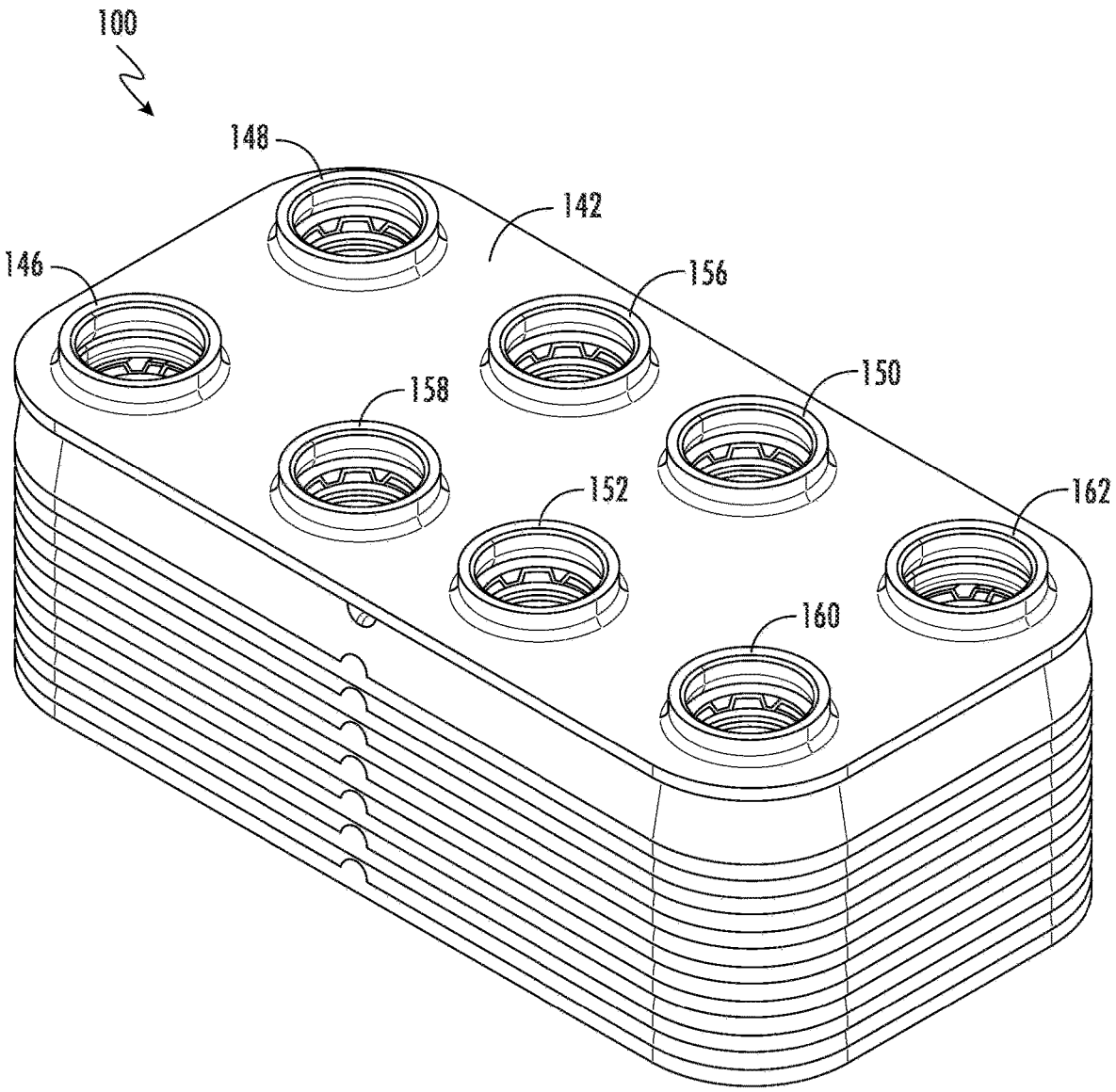
FIG. 8 shows a perspective view of a combination heat exchanger in accordance with another embodiment of the presently described subject matter, wherein the combination heat exchanger includes a plurality of plates and one or more transfer devices in a stacked relationship.

As best seen in FIGS. 4 and 5, the plates 40, 41 may be configured to define one or more first flow paths 61 (depicted schematically by arrows A) for the first fluid/medium, a second flow path 71 (depicted schematically by arrows B) for the second fluid/medium, and a third flow path 81 (depicted schematically by arrows C) for the third fluid/medium.

Each of the first plates 40 may include a divider 62 formed therein substantially perpendicular to a longitudinal axis of the first plate 40. The divider 62 generally divides the combination heat exchanger 10 into separate first and second portions, wherein each portion may function as a separate heat exchanger. In the embodiment shown, the divider 62 of each of the first plates 40 extends away from a first surface 65 and abuts a substantially planar first surface 67 of an adjacent one of the second plates 41 to form the second flow path 71 and the third flow path 81.

In preferred embodiments, the first plate 40 includes an inflow opening 64 and an outflow opening 66 formed therein and the second plate 41 includes an inflow opening 86 and an outflow opening 88. The inflow openings 64, 86 may be fluidly connected to the inlet port 46 and the outflow openings 66, 88 may be fluidly connected to the outlet port 56. The inflow openings 64, 86 and the outflow openings 66, 88 may be diagonally, opposed being located in diagonally, opposite corners of the respective first and second plates 40, 41 and on opposite sides of the divider 62. Accordingly, the first fluid/medium may flow from the inflow openings 64, 86, through a substantial portion or an entirety of the combination heat exchanger 10 via the first flow path 61, to the outflow openings 66, 88, thereby a distance from the inflow openings 64, 86 to the outflow openings 66, 88 that the first fluid/medium has to travel may be maximized.

In the embodiment shown, each of the first plates 40 may further include one or more shaped sections 63 formed therein. Each of the shaped section 63 surrounds a periphery of inflow and outflow openings 64, 66 formed in the first plate 40 and abuts a first surface 67 of the second plate 41 to form the first flow path 61 and militate against leakage of the first fluid/medium into the second and third flow paths 71, 81 and the second and third fluid/mediums into the first flow path 61.

In preferred embodiments, the first plate 40 further includes an inflow opening 72 and an outflow opening 74 formed therein and the second plate 41 includes an inflow opening 90 and an outflow opening 92. The inflow openings 72, 90 may be fluidly connected to the inlet port 48, and the outflow openings 74, 92 may be fluidly connected to the outlet port 58. In preferred embodiments, the inflow openings 72, 90 and the outflow openings 74, 92 may be diagonally, opposed but on the same side of the divider 62. Accordingly, the second fluid/medium may flow from the inflow openings 72, 90, through a substantial portion or an entirety of the first portion of the combination heat exchanger 10 via the second flow path 71, to the outflow openings 74, 92, thereby a distance from the inflow openings 72, 90 to the outflow openings 74, 92 that the second fluid/medium has to travel within the first portion of the combination heat exchanger 10 is maximized.

In the embodiment shown, each of the second plates 41 may further include one or more shaped section 93 formed therein. Each of the shaped section 93 surrounds a periphery of inflow and outflow openings 90, 92 formed in the second plate 41 and abuts the first surface 65 of the adjacent first plate 40 to form the second flow path 71 and militate against leakage of the second fluid/medium into the first and third flow paths 61, 81 and the first and third fluid/mediums into the second flow path 71.

In preferred embodiments, the first plate 40 further includes an inflow opening 82 and an outflow opening 84 formed therein and the second plate 41 includes an inflow opening 94 and an outflow opening 96. The inflow openings 82, 94 may be fluidly connected to the inlet port 50, and the outflow openings 84, 96 may be fluidly connected to the outlet port 60. In preferred embodiments, the inflow openings 82, 94 and the outflow openings 84, 96 may be diagonally, opposed but on the same side of the divider 62. Accordingly, the third fluid/medium may flow from the inflow openings 82, 94, through a substantial portion or an entirety of the second portion of the combination heat exchanger 10 via the third flow path 81, to the outflow openings 84, 96, thereby a distance from the inflow openings 82, 94 to the outflow openings 84, 96 that the third fluid/medium has to travel within the second portion of the combination heat exchanger 10 is maximized.

In the embodiment shown, each of the second plates 41 may further include one or more shaped section 97 formed therein. Each of the shaped section 97 surrounds a periphery of inflow and outflow openings 94, 96 formed in the second plate 41 and abuts the first surface 65 of the adjacent first plate 40 to form the third flow path 81 and militate against leakage of the third fluid/medium into the first and second flow paths 61, 71 and the first and second fluid/mediums into the third flow path 81.

It is understood that each of the inflow openings 64, 72, 82, 86, 90, 94 and the outflow openings 66, 74, 84, 88, 92, 96 may be located elsewhere in the respective first and second plates 40, 41 to achieve a desired thermal energy exchange between the first fluid/medium and the second fluid/medium and the third fluid/medium.

Figure 2:
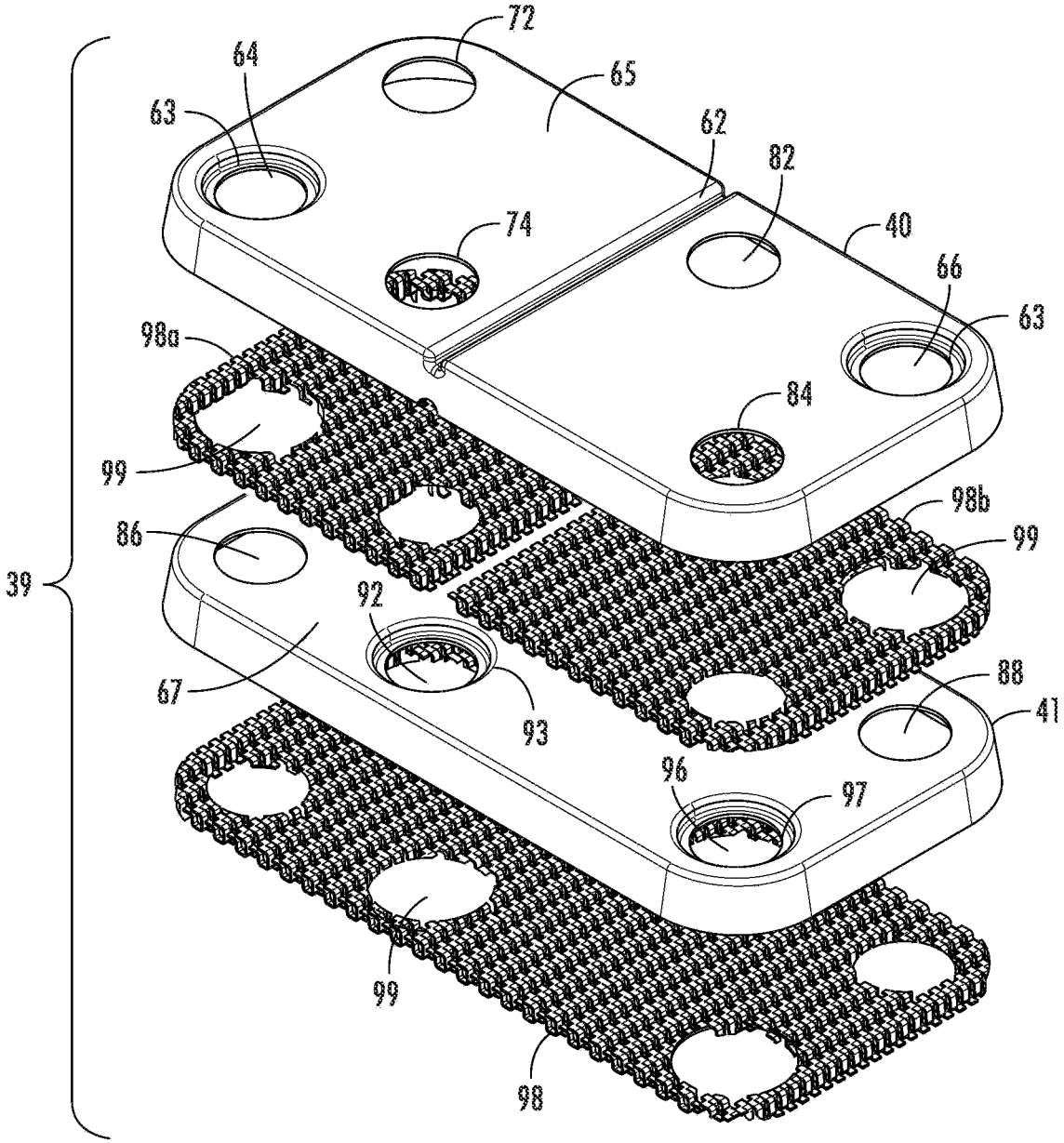
FIG. 2 shows an exploded view of the plates and the transfer devices of the combination heat exchanger of FIG. 1.
Figure 3:
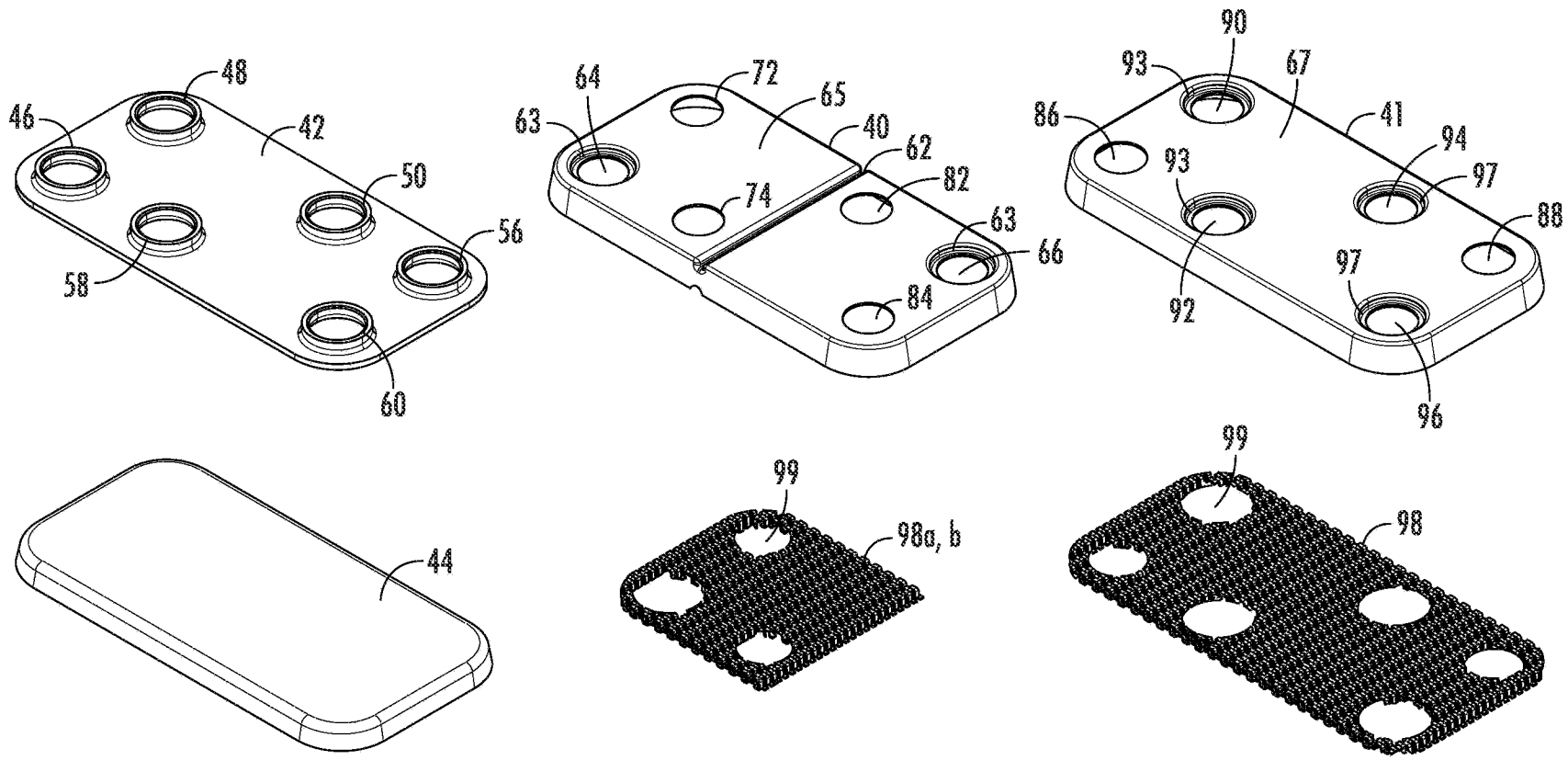
FIG. 3 shows each of the plates and the transfer devices of the combination heat exchanger of FIG. 1.

At least one thermal energy transfer device 98, for example, fins, may be disposed in at least a portion of at least one of the first flow path 61, the second flow path 71, and the third flow path 81, to enhance and improve a rate of thermal energy transfer between the first fluid/medium and the second fluid/medium and the third fluid/medium within the combination heat exchanger 10. As best shown in FIG. 2, the combination heat exchanger 10 includes a transfer device 98 disposed between the first and second plates 40, 41 in the first flow path 61, a transfer device 98*a* disposed in the first portion of the combination heat exchanger 10 between the first and second plates 40, 41 in the second flow path 71, and a transfer device 98*b* disposed in the second portion of the combination heat exchanger 10 between the first and second plates 40, 41 in the third flow path 81. The transfer devices 98, 98*a*, 98*b* may include one or more openings 99 formed therein to accommodate the shaped sections 63, 93, 97. In a particular embodiment, the combination heat exchanger 10 includes seven (7) of the transfer devices 98, seven (7) of the transfer devices 98*a*, and seven (7) of the transfer devices 98*b*. It is understood, however, that the combination heat exchanger 10 may include any number of the transfer devices 98, 98*a*, 98*b* as desired.

As best shown in FIGS. 4-5, the first flow path 61 and the second and third flow paths 71, 81 are formed alternately between the plates 40, 41 and the end plates 42, 44. The inlet openings 64, 86 of the plates 40, 41, respectively, are fluidly connected to form an inlet manifold for the first fluid/medium, which is fluidly coupled to the inlet port 46, and the outlet openings 66, 88 of the plates 40, 41, respectively, are fluidly connected to form an outlet manifold for the first fluid/medium, which is fluidly coupled to the outlet port 56. As such, the first fluid/medium of the first circuit 12 flows into the inlet port 46, through the inlet manifold and the associated first flow paths 61 defined by the plates 40, 41 where an exchange of thermal energy occurs between the first fluid/medium and the second and third fluid/mediums, through the outlet manifold, and from the outlet port 56 back into the first circuit 12.

Similarly, the inlet openings 72, 90 of the plates 40, 41, respectively, are fluidly connected to form an inlet manifold for the second fluid/medium, which is fluidly coupled to the inlet port 48, and the outlet openings 74, 92 of the plates 40, 41, respectively, are fluidly connected to form an outlet manifold for the second fluid/medium, which is fluidly coupled to the outlet port 58. As such, the second fluid/medium of the second circuit 14 flows into the inlet port 48, through the inlet manifold and the associated second flow paths 71 defined by the plates 40, 41 where an exchange of thermal energy occurs between the first fluid/medium and the second fluid/medium, through the outlet manifold, and from the outlet port 58 back into the second circuit 14.

Additionally, the inlet openings 82, 94 of the plates 40, 41, respectively, are fluidly connected to form an inlet manifold for the third fluid/medium, which is fluidly coupled to the inlet port 50, and the outlet openings 84, 96 of the plates 40, 41, respectively, are fluidly connected to form an outlet manifold for the third fluid/medium, which is fluidly coupled to the outlet port 60. As such, the third fluid/medium of the third circuit 16 flows into the inlet port 50, through the inlet manifold and the associated third flow paths 81 defined by the plates 40, 41 where an exchange of thermal energy occurs between the first fluid/medium and the third fluid/medium, through the outlet manifold, and from the outlet port 60 back into the third circuit 16.

Performance of the combination heat exchanger 10 may be optimized in various ways. For example, the combination heat exchanger 10 may be optimized by adjusting locations of at least one of the inlet ports 46, 48, 50; at least one of the outlet ports 56, 58, 60; at least one of the inlet openings 64, 72, 82, 86, 90, 94; and/or at least one of the outlet openings 66, 74, 84, 88, 92, 96; by providing different flow resistance (i.e., more of less transfer devices 98, 98*a*, 98*b* disposed in the flow paths 61, 71, 81); and/or by varying a cross-sectional flow area of at least one of the flow paths 61, 71, 81.

The combination heat exchanger 100 being integrated into the first circuit 112, the second circuit 114, the third circuit 116, and the fourth circuit 118 permits the first fluid/medium to transfer thermal energy to the second fluid/medium and the third fluid/medium to transfer thermal energy to the fourth fluid/medium. In some embodiments, the combination heat exchanger 100 may function as a condenser, an economizer, and an integrated heat exchanger in at least one of the first, second, third, and fourth circuits 112, 114, 116, 118, of the conditioning system.

A plurality of first plates 140 (i.e., A-plates) and a plurality of second plates 141 (i.e., A-plates rotated 180 degrees) alternatingly arranged one on top of each other in a stacked relationship forming at least one A-Rotated A plate assembly 139 between opposing end plates 142, 144. It is understood that one or more of the end plates 142, 144 may be part of a housing of the combination heat exchanger 100 if desired. In a particular embodiment, the combination heat exchanger 100 includes seven (7) of the first plates 140 and seven (7) of the second plates 141 in stacked relationship between the end plates 142, 144. It is understood, however, that the combination heat exchanger 100 may include any number of the plates 140, 141 as desired.

Inlet ports 146, 148, 150, 152 and corresponding outlet ports 156, 158, 160, 162 for each of the first, second, third, and fourth circuits 112, 114, 116, 118, respectively, are formed in one of the end plates 142, 144. In some embodiments, the inlet ports 146, 148, 150, 152 and the outlet ports 156, 158, 160, 162 are integrally formed with the one of the end plates 142, 144, yet in other embodiments they are formed as separate and distinct components that are coupled to the one of the end plates 142, 144.

FIGS. 8-14B show the first plates 140 and the second plate 141 of the combination heat exchanger 100 in accordance with an embodiment of the present disclosure. Each of the first and second plates 140, 141 and/or each of the end plates 142, 144 may be substantially elongate and rectangular. In some embodiments, each of the first and second plates 140, 141 may have a thickness of about 0.48 mm and each of the end plates 142, 144 may have a thickness of about 2.0 mm. However, it is understood that the first and second plates 140, 141 and the end plates 142, 144 may have various shapes, sizes, and configurations as desired. As illustrated, the first and second plates 140, 141 are substantially similar or the same.

Figure 11:
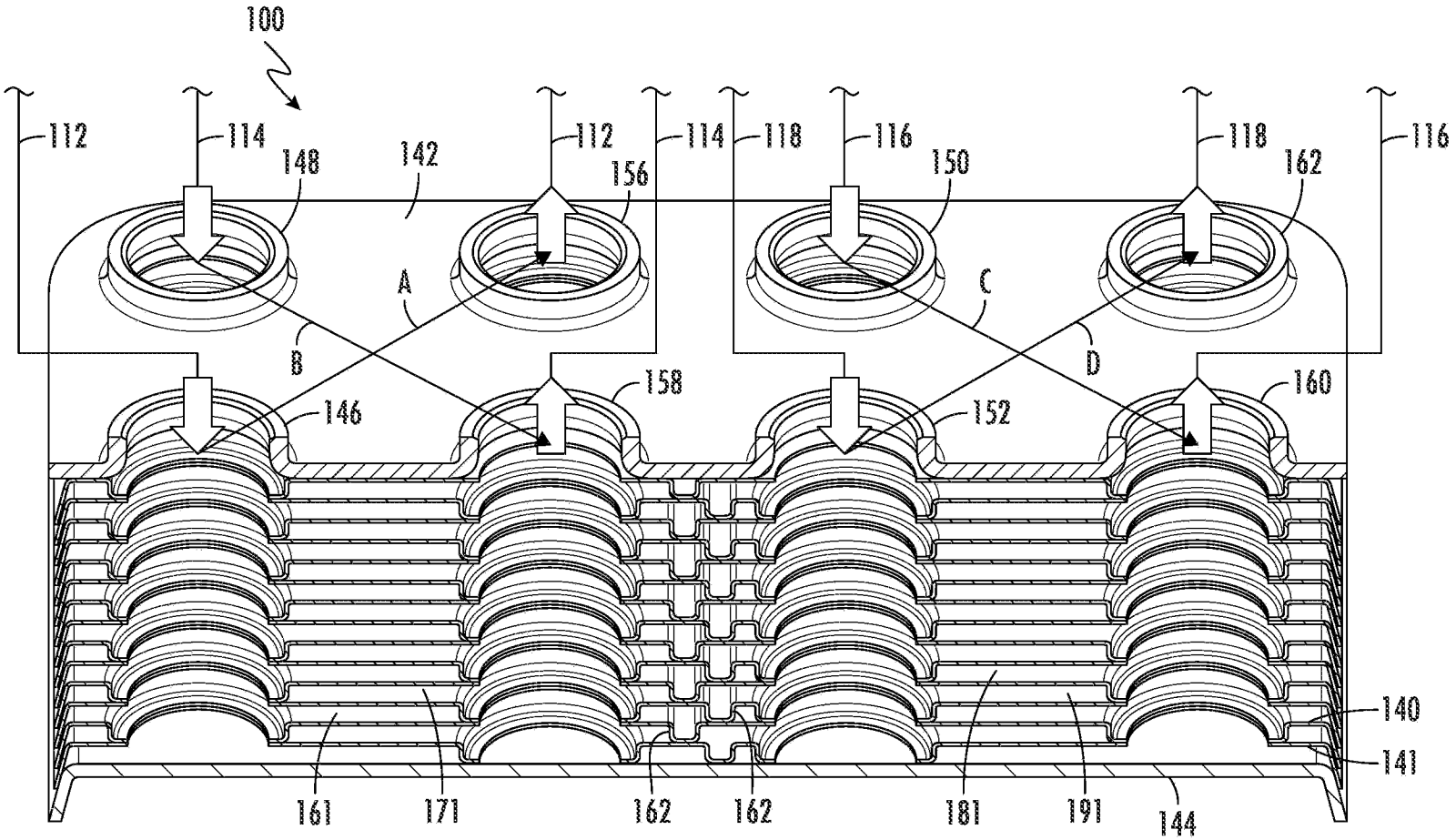
FIG. 11 shows a cross-sectional view of the combination heat exchanger of FIG. 8 depicting a flow circuitry thereof, wherein a first fluid/medium exchanges thermal energy with a second fluid/medium and a third fluid/medium exchanges thermal energy with a fourth fluid/medium.
Figure 12:
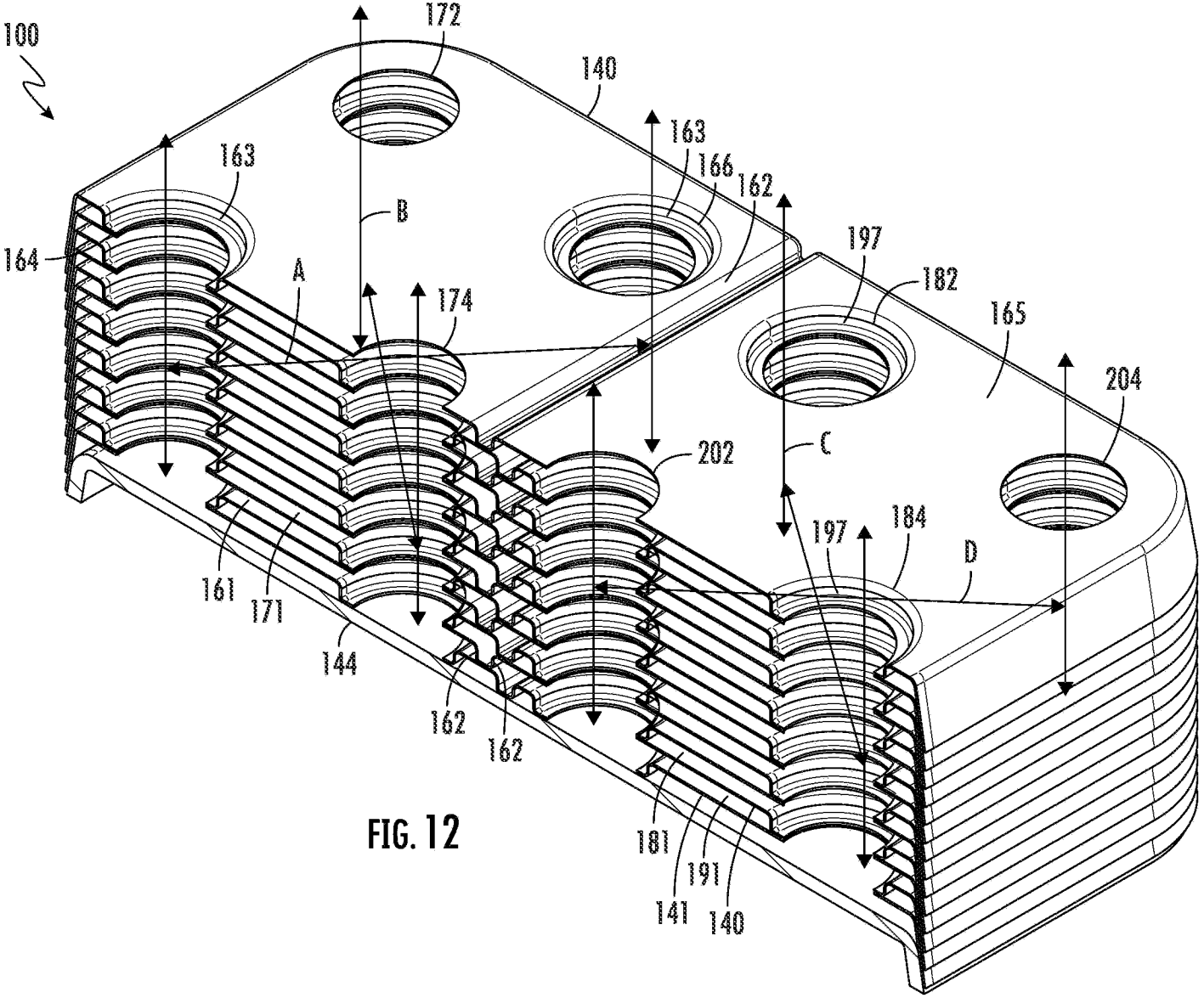
FIG. 12 shows a perspective sectional view of the combination heat exchanger of FIG. 8 depicting the flow circuitry thereof and an end plate removed, wherein the first fluid/medium exchanges thermal energy with the second fluid/medium and the third fluid/medium exchanges thermal energy with the fourth fluid/medium.
Figure 13:
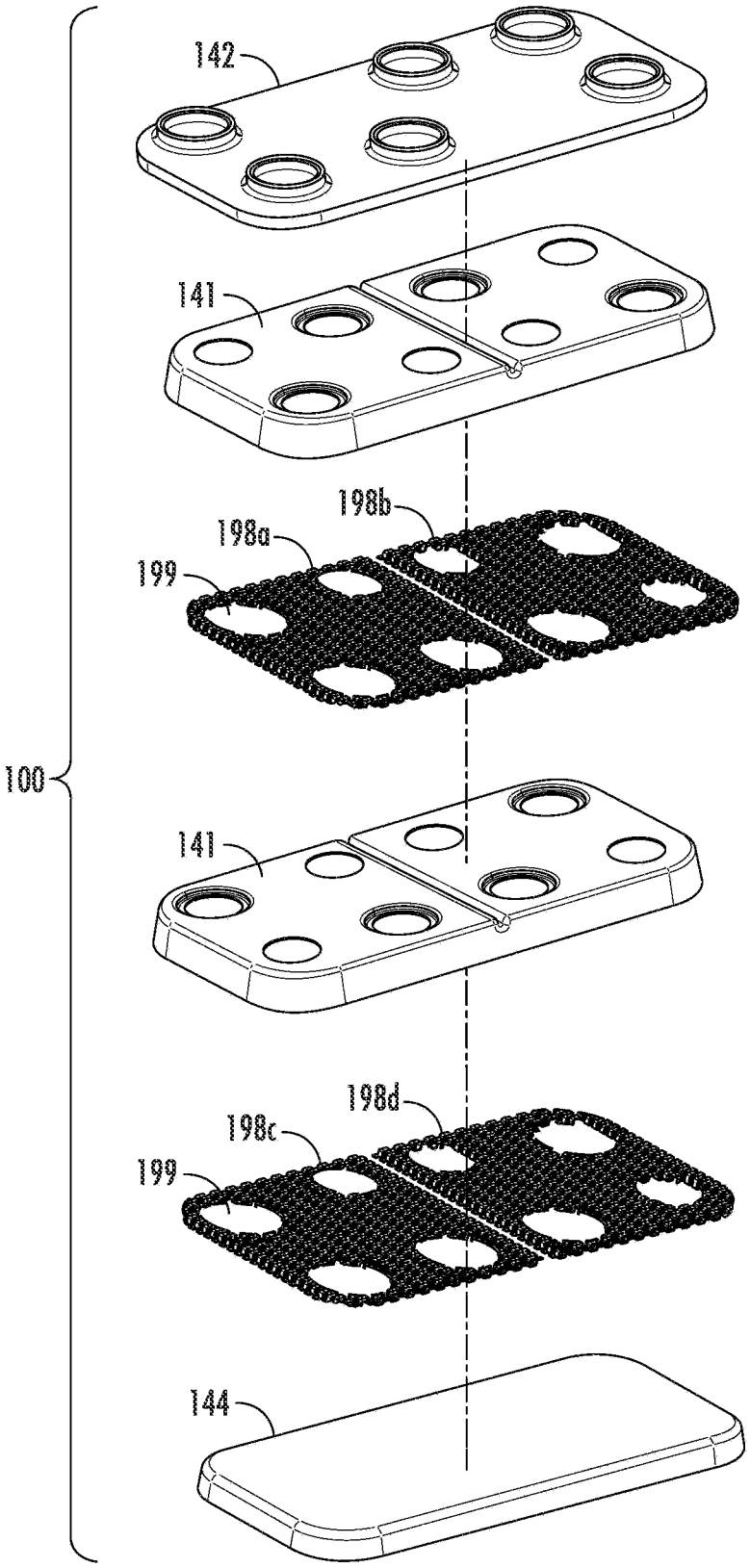
FIG. 13 shows an exploded view of the combination heat exchanger of FIG. 8.
Figure 14B:
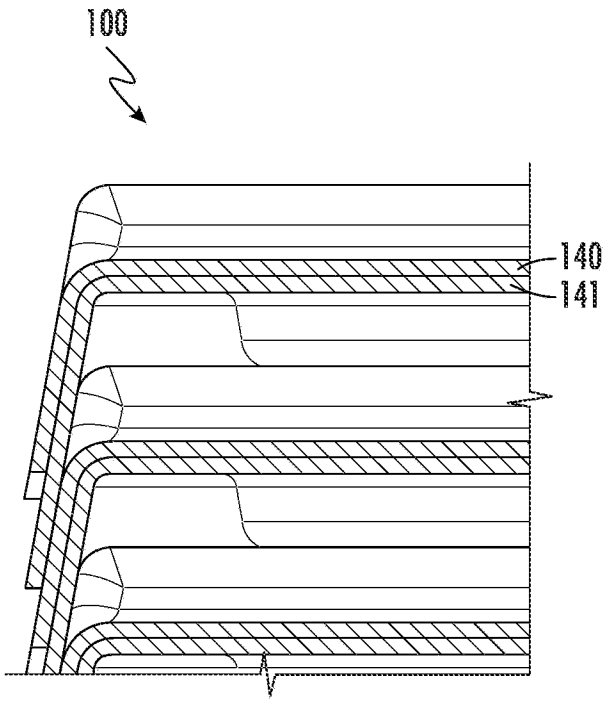
FIG. 14B shows a fragmentary cross-sectional view of an end portion of the combination heat exchanger of FIG. 8.
Figure 14A:
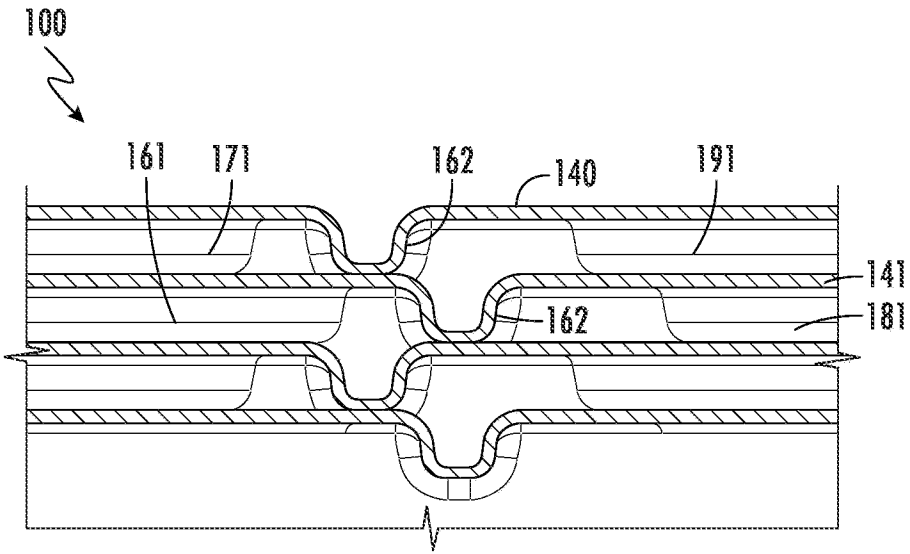
FIG. 14A shows a fragmentary cross-sectional view of an intermediate portion of the combination heat exchanger of FIG. 8.

As best seen in FIGS. 11 and 12, the plates 140, 141 may be configured to define one or more first flow paths 161 (depicted schematically by arrows A) for the first fluid/medium, a second flow path 171 (depicted schematically by arrows B) for the second fluid/medium, a third flow path 181 (depicted schematically by arrows C) for the third fluid/medium, and a fourth flow path 191 (depicted schematically by arrows D) for the fourth fluid/medium.

Each of the plates 140, 141 may include a divider 162 formed therein substantially perpendicular to a longitudinal axis of the plates 140, 141. The divider 162 generally divides the combination heat exchanger 100 into separate first and second portions, wherein each portion may function as a separate heat exchanger. In the embodiment shown, the divider 162 of each of the first plates 140 extends away from a first surface 165 and abuts a substantially planar first surface 167 of an adjacent one of the second plates 141 to form the second flow path 171 and the fourth flow path 191. Similarly, the divider 162 of each of the second plates 141 extends away from the first surface 167 and abuts the first surface 165 of an adjacent one of the first plates 140 to form the first flow path 161 and the third flow path 181.

In preferred embodiments, the first plate 140 includes an inflow opening 164 and an outflow opening 166 formed therein and the second plate 141 includes an inflow opening 186 and an outflow opening 188. The inflow openings 164, 186 may be fluidly connected to the inlet port 146 and the outflow openings 166, 188 may be fluidly connected to the outlet port 156. The inflow openings 164, 186 and the outflow openings 166, 188 may be diagonally, opposed being located in diagonally, opposite corners of the first portion of the combination heat exchanger 100 and on the same side of the divider 162. Accordingly, the first fluid/medium may flow from the inflow openings 164, 186, through a substantial portion or an entirety of the first portion of the combination heat exchanger 10 via the first flow path 161, to the outflow openings 166, 188, thereby a distance from the inflow openings 164, 186 to the outflow openings 166, 188 that the first fluid/medium has to travel may be maximized.

In the embodiment shown, each of the first plates 140 may further include one or more shaped sections 163 formed therein. Each of the shaped section 163 surrounds a periphery of inflow and outflow openings 164, 166 formed in the first plate 140 and abuts the first surface 167 of the second plate 141 to form the first flow path 161 and militate against leakage of the first fluid/medium into the second flow paths 171 and the second fluid/medium into the first flow path 161.

In preferred embodiments, the first plate 140 further includes an inflow opening 172 and an outflow opening 174 formed therein and the second plate 141 includes an inflow opening 190 and an outflow opening 192. The inflow openings 172, 190 may be fluidly connected to the inlet port 148, and the outflow openings 174, 192 may be fluidly connected to the outlet port 158. In preferred embodiments, the inflow openings 172, 190 and the outflow openings 174, 192 may be diagonally, opposed in the first portion of the heat exchange 100 but on the same side of the divider 162. Accordingly, the second fluid/medium may flow from the inflow openings 172, 190, through a substantial portion or an entirety of the first portion of the combination heat exchanger 100 via the second flow path 171, to the outflow openings 174, 190, thereby a distance from the inflow openings 172, 190 to the outflow openings 174, 192 that the second fluid/medium has to travel within the first portion of the combination heat exchanger 100 is maximized.

In the embodiment shown, each of the second plates 141 may further include one or more shaped section 193 formed therein. Each of the shaped section 193 surrounds a periphery of inflow and outflow openings 190, 192 formed in the second plate 141 and abuts the first surface 165 of the adjacent first plate 140 to form the second flow path 171 and militate against leakage of the second fluid/medium into the first flow path 161 and the first fluid/mediums into the second flow path 171.

In preferred embodiments, the first plate 140 further includes an inflow opening 182 and an outflow opening 184 formed therein and the second plate 141 includes an inflow opening 194 and an outflow opening 196. The inflow openings 182, 194 may be fluidly connected to the inlet port 150, and the outflow openings 184, 196 may be fluidly connected to the outlet port 160. In preferred embodiments, the inflow openings 182, 194 and the outflow opening 184, 196 may be diagonally, opposed in the second portion of the combination heat exchanger 100 but on the same side of the divider 162. Accordingly, the third fluid/medium may flow from the inflow openings 182, 194, through a substantial portion or an entirety of the second portion of the combination heat exchanger 100 via the third flow path 181, to the outflow openings 184, 196, thereby a distance from the inflow openings 182, 194 to the outflow openings 184, 196 that the third fluid/medium has to travel within the second portion of the combination heat exchanger 100 is maximized.

In the embodiment shown, each of the first plates 140 may further include one or more shaped section 197 formed therein. Each of the shaped section 197 surrounds a periphery of inflow and outflow openings 182, 184 formed in the first plate 140 and abuts the first surface 167 of the adjacent second plate 141 to form the third flow path 181 and militate against leakage of the third fluid/medium into the fourth flow path 191 and the fourth fluid/medium into the third flow path 181.

In preferred embodiments, the first plate 140 further includes an inflow opening 202 and an outflow opening 204 formed therein and the second plate 141 includes an inflow opening 206 and an outflow opening 208. The inflow openings 202, 206 may be fluidly connected to the inlet port 152, and the outflow openings 204, 208 may be fluidly connected to the outlet port 162. In preferred embodiments, the inflow openings 202, 206 and the outflow openings 204, 208 may be diagonally, opposed in the second portion of the combination heat exchanger 100 but on the same side of the divider 162. Accordingly, the fourth fluid/medium may flow from the inflow openings 202, 206, through a substantial portion or an entirety of the second portion of the combination heat exchanger 100 via the fourth flow path 191, to the outflow openings 204, 208, thereby a distance from the inflow openings 202, 206 to the outflow openings 204, 208 that the fourth fluid/medium has to travel within the second portion of the combination heat exchanger 100 is maximized.

In the embodiment shown, each of the second plates 141 may further include one or more shaped section 210 formed therein. Each of the shaped section 210 surrounds a periphery of inflow and outflow openings 206, 208 formed in the second plate 141 and abuts the first surface 165 of the adjacent first plate 140 to form the fourth flow path 191 and militate against leakage of the fourth fluid/medium into the third flow path 181 and the third fluid/medium into the fourth flow path 191.

It is understood that each of the inflow openings 164, 172, 182, 186, 190, 194, 202, 206 and the outflow openings 166, 174, 184, 188, 192, 196, 204, 208 may be located elsewhere in the respective first and second plates 140, 141 to achieve a desired thermal energy exchange between the first fluid/medium and the second fluid/medium and between the third fluid/medium and the fourth fluid/medium.

Figure 9:
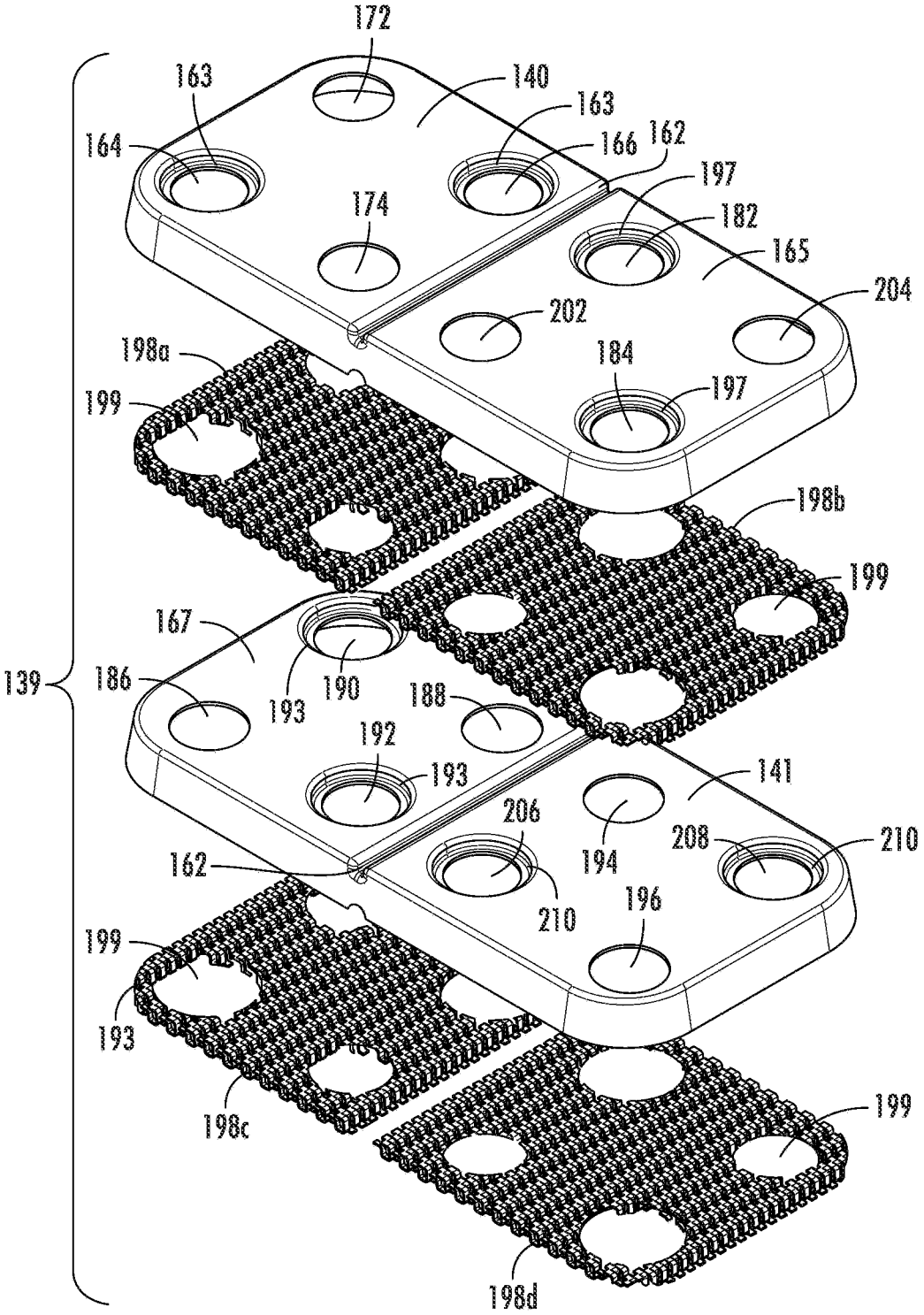
FIG. 9 shows an exploded view of the plates and the transfer devices of the combination heat exchanger of FIG. 8.
Figure 10:
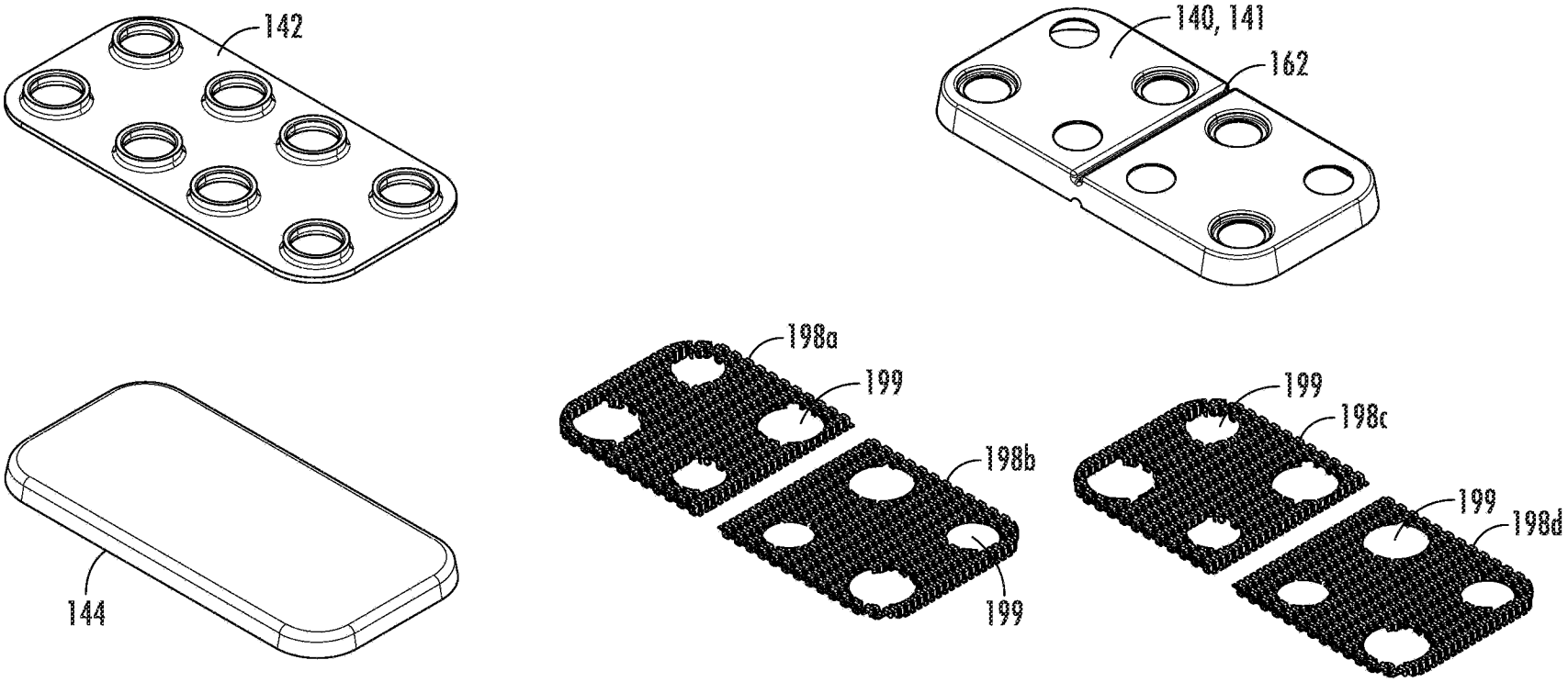
FIG. 10 shows each of the plates and the transfer devices of the combination heat exchanger of FIG. 8.

At least one thermal energy transfer device 198, for example, fins, may be disposed in at least a portion of at least one of the first flow path 161, the second flow path 171, the third flow path 181, and the fourth flow path 191 to enhance and improve a rate of thermal energy transfer between the first fluid/medium and the second fluid/medium and between the third fluid/medium and the fourth fluid/medium within the combination heat exchanger 100. As best shown in FIG. 9, the combination heat exchanger 100 includes a transfer device 198*a* disposed in the first portion of the combination heat exchanger 100 between the first and second plates 140, 141 in the first flow path 161, a transfer device 198*b* disposed in the second portion of the combination heat exchanger 100 between the first and second plates 140, 141 in the third flow path 181, a transfer device 198*c* disposed in the first portion of the combination heat exchanger 100 between the first and second plates 140, 141 in the second flow path 171, and a transfer device 198*d* disposed in the second portion of the combination heat exchanger 100 between the first and second plates 140, 141 in the fourth flow path 191. The transfer devices 198*a*, 198*b*, 198*c*, 198*d* may include one or more openings 199 formed therein to accommodate the shaped sections 163, 193, 197, 210. In a particular embodiment, the combination heat exchanger 100 includes seven (7) of the transfer devices 198*a*, seven (7) of the transfer devices 198*b*, seven (7) of the transfer devices 198*c*, and seven (7) of the transfer devices 198*d*. It is understood, however, that the combination heat exchanger 100 may include any number of the transfer devices 198*a*, 198*b*, 198*c*, 198*d* as desired.

As best shown in FIGS. 11-12, the first flow path 161 and the third flow path 181 are formed alternately with the second flow path 171 and the fourth flow path 191 between the plates 140, 141 and the end plates 142, 144. The inlet openings 164, 186 of the plates 140, 141, respectively, are fluidly connected to form an inlet manifold for the first fluid/medium, which is fluidly coupled to the inlet port 146, and the outlet openings 166, 188 of the plates 140, 141, respectively, are fluidly connected to form an outlet manifold for the first fluid/medium, which is fluidly coupled to the outlet port 156. As such, the first fluid/medium of the first circuit 112 flows into the inlet port 146, through the inlet manifold and the associated first flow paths 161 defined by the plates 140, 141 where an exchange of thermal energy occurs between the first fluid/medium and the second fluid/medium, through the outlet manifold, and from the outlet port 156 back into the first circuit 112.

Similarly, the inlet openings 172, 190 of the plates 140, 141, respectively, are fluidly connected to form an inlet manifold for the second fluid/medium, which is fluidly coupled to the inlet port 148, and the outlet openings 174, 192 of the plates 140, 141, respectively, are fluidly connected to form an outlet manifold for the second fluid/medium, which is fluidly coupled to the outlet port 158. As such, the second fluid/medium of the second circuit 114 flows into the inlet port 148, through the inlet manifold and the associated second flow paths 171 defined by the plates 140, 141 where an exchange of thermal energy occurs between the first fluid/medium and the second fluid/medium, through the outlet manifold, and from the outlet port 158 back into the second circuit 114.

Additionally, the inlet openings 182, 194 of the plates 140, 141, respectively, are fluidly connected to form an inlet manifold for the third fluid/medium, which is fluidly coupled to the inlet port 150, and the outlet openings 184, 196 of the plates 140, 141, respectively, are fluidly connected to form an outlet manifold for the third fluid/medium, which is fluidly coupled to the outlet port 160. As such, the third fluid/medium of the third circuit 116 flows into the inlet port 150, through the inlet manifold and the associated third flow paths 181 defined by the plates 140, 141 where an exchange of thermal energy occurs between the third fluid/medium and the fourth fluid/medium, through the outlet manifold, and from the outlet port 160 back into the third circuit 116.

Similarly, the inlet openings 202, 206 of the plates 140, 141, respectively, are fluidly connected to form an inlet manifold for the fourth fluid/medium, which is fluidly coupled to the inlet port 152, and the outlet openings 204, 208 of the plates 140, 141, respectively, are fluidly connected to form an outlet manifold for the fourth fluid/medium, which is fluidly coupled to the outlet port 162. As such, the fourth fluid/medium of the fourth circuit 118 flows into the inlet port 152, through the inlet manifold and the associated fourth flow paths 191 defined by the plates 140, 141 where an exchange of thermal energy occurs between the third fluid/medium and the fourth fluid/medium, through the outlet manifold, and from the outlet port 162 back into the fourth circuit 118.

Performance of the combination heat exchanger 100 may be optimized in various ways. For example, the combination heat exchanger 100 may be optimized by adjusting locations of at least one of the inlet ports 146, 148, 150, 152; at least one of the outlet ports 156, 158, 160, 162; at least one of the inlet openings 164, 172, 182, 186, 190, 194, 202, 206; and/or at least one of the outlet openings 166, 174, 184, 188, 192, 196, 204, 208; by providing different flow resistance (i.e., more of less transfer devices 198*a*, 198*c*, 198*b*, 198*d* disposed in the flow paths 161, 171, 181, 191); and/or by varying a cross-sectional flow area of at least one of the flow paths 161, 171, 181, 191.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A heat exchanger, comprising:

a plurality of first plates; and a plurality of second plates alternatingly arranged with the first plates to form a first flow path for a first fluid/medium, a second flow path for a second fluid/medium, and a third flow path for a third fluid/medium, wherein the first fluid/medium is in thermal energy exchange relationship with the second fluid/medium and the third fluid/medium, wherein at least one of the first and second plates includes at least one divider to define a first portion of the heat exchanger and a second portion of the heat exchanger, wherein the at least one divider of each of the first plates extends away from a surface thereof and abuts a substantially planar surface of an adjacent one of the second plates to form the second flow path and the third flow path, wherein at least one of the first and second plates includes three inflow openings and three outflow openings, and wherein one inflow opening and one outflow opening for the first fluid/medium are diagonally opposite each other and are located on opposite sides of the heat exchanger when assembled, one inflow opening and one outflow opening for the second fluid/medium are diagonally opposite each other in the first portion of the heat exchanger and are located on the same side of the divider, and one inflow opening and one outflow opening for the third fluid/medium are diagonally opposite each other in the second portion of the heat exchanger and are located on the same side of the divider, wherein the second flow path and the third flow path are arranged adjacent one another, wherein the first flow path is alternatingly arranged on opposite sides of the adjacent second and third flow paths, and wherein the first flow path extends through the heat exchanger such that a distance from the inflow opening to the outflow opening that the first fluid/medium has to travel within the heat exchanger is maximized.

2. The heat exchanger of claim 1, wherein the second flow path is located entirely in the first portion of the heat exchanger and the third flow path is formed entirely in the second portion of the heat exchanger.

3. The heat exchanger of claim 1, wherein at least one of the first and second plates includes at least one shaped section surrounding at least one inflow opening.

4. The heat exchanger of claim 1, wherein at least one of the first and second plates includes at least one shaped section surrounding at least one outflow opening.

5. The heat exchanger of claim 1, further comprising at least one end plate disposed adjacent at least one of the first and second plates.

6. The heat exchanger of claim 5, wherein the at least one end plate includes at least three inlet ports.

7. The heat exchanger of claim 5, wherein the at least one end plate includes at least three outlet ports.

8. A heat exchanger, comprising:

a plurality of first plates; and a plurality of second plates alternatingly arranged with the first plates to form a first flow path for a first fluid/medium, a second flow path for a second fluid/medium, a third flow path for a third fluid/medium, and a fourth flow path for a fourth fluid/medium, wherein the first fluid/medium is in thermal energy exchange relationship with the second fluid/medium and the third fluid/medium is in thermal energy exchange relationship with the fourth fluid/medium, wherein each of the first and second plates includes a divider to define a first portion of the heat exchanger and a second portion of the heat exchanger, wherein the divider of each of the first plates extends away from a surface thereof, and abuts a substantially planar surface of an adjacent one of the second plates to form the second flow path and the fourth flow path, and the divider of each of the second plates extends away from a surface thereof and abuts a substantially planar surface of an adjacent one of the first plates to form the first flow path and the third flow path, wherein the dividers of the first plates are laterally offset from the dividers of the second plates, wherein at least one of the first and second plates includes four inflow openings and four outflow openings, wherein one inflow opening and one outflow opening for the first fluid/medium are diagonally opposite each other in the first portion of the heat exchanger and are located on the same side of the dividers, one inflow opening and one outflow opening for the second fluid/medium are diagonally opposite each other in the first portion of the heat exchanger and are located on the same side of the dividers, one inflow opening and one outflow opening for the third fluid/medium are diagonally opposite each other in the second portion of the heat exchanger and are located on the same side of the dividers, and one inflow opening and one outflow opening for the fourth fluid/medium are diagonally opposite each other in the second portion of the heat exchanger and are located on the same side of the dividers, and wherein the first and second flow paths are located on one side of the dividers and the third and fourth flow paths are located on another side of the dividers opposite the first and second flow paths such that a distance from the respective inflow opening to the respective outflow opening that each fluid/medium has to travel within the respective portion of the heat exchanger is maximized.

9. The heat exchanger of claim 8, wherein at least one of the first flow path and the second flow path is located entirely in the first portion of the heat exchanger.

10. The heat exchanger of claim 8, wherein at least one of the third flow path and the fourth flow path is located entirely in the second portion of the heat exchanger.

11. The heat exchanger of claim 8, wherein at least one of the first and second plates includes at least one shaped section surrounding at least one inflow opening.

12. The heat exchanger of claim 8, wherein at least one of the first and second plates includes at least one shaped section surrounding at least one outflow opening.

13. The heat exchanger of claim 8, further comprising at least one end plate disposed adjacent at least one of the first and second plates.

14. The heat exchanger of claim 13, wherein the at least one end plate includes at least three inlet ports.

15. The heat exchanger of claim 13, wherein the at least one end plate includes at least three outlet ports.

16. The heat exchanger of claim 8, wherein each of the first plates has a first plate geometry and each of the second plates has a second plate geometry that is substantially the same as the first plate geometry.

17. The heat exchanger of claim 8, wherein each of the second plates comprises one of the first plates, and each of the second plates is rotated by 180 degrees relative to an adjacent one of the first plates when assembled into the heat exchanger.

* * * * *